US009365916B2

(12) United States Patent
Floyd et al.

(10) Patent No.: US 9,365,916 B2
(45) Date of Patent: Jun. 14, 2016

(54) BULK IRON-NICKEL GLASSES BEARING PHOSPHORUS-BORON AND GERMANIUM

(71) Applicant: Glassimetal Technology, Inc., Pasadena, CA (US)

(72) Inventors: Michael Floyd, Pasadena, CA (US); Jong Hyun Na, Pasadena, CA (US); Marios D. Demetriou, West Hollywood, CA (US); William L. Johnson, San Marino, CA (US); Glenn Garrett, Pasadena, CA (US)

(73) Assignee: Glassimetal Technology, Inc., Pasadena, CA (US)

( * ) Notice: Subject to any disclaimer, the term of this patent is extended or adjusted under 35 U.S.C. 154(b) by 246 days.

(21) Appl. No.: 14/077,830

(22) Filed: Nov. 12, 2013

(65) Prior Publication Data

US 2014/0130942 A1 May 15, 2014

Related U.S. Application Data

(60) Provisional application No. 61/725,394, filed on Nov. 12, 2012.

(51) Int. Cl.

| | |
|---|---|
| ***C22C 45/02*** | (2006.01) |
| ***C22C 45/04*** | (2006.01) |
| ***C22C 1/00*** | (2006.01) |
| ***C22C 45/00*** | (2006.01) |

(52) U.S. Cl.

CPC ..... *C22C 45/04* (2013.01); *C22C 1/002* (2013.01); *C22C 45/008* (2013.01)

(58) Field of Classification Search

None

See application file for complete search history.

(56) References Cited

U.S. PATENT DOCUMENTS

| | | | | |
|---|---|---|---|---|
| 3,856,513 | A * | 12/1974 | Chen | B22D 11/005 148/403 |
| 4,126,284 | A | 11/1978 | Ichikawa et al. | |
| 4,144,058 | A | 3/1979 | Chen et al. | |
| 4,152,144 | A | 5/1979 | Hasegawa et al. | |
| 4,385,932 | A | 5/1983 | Inomata et al. | |
| 4,582,536 | A | 4/1986 | Raybould | |
| 4,892,628 | A | 1/1990 | Guilinger | |
| 4,900,638 | A | 2/1990 | Emmerich | |

(Continued)

FOREIGN PATENT DOCUMENTS

| | | |
|---|---|---|
| DE | 3929222 | 3/1991 |
| DE | 10 2011 001 784 | 10/2012 |

(Continued)

OTHER PUBLICATIONS

Park T.G. et al., "Development of new Ni-based amorphous alloys containing no metalloid that have large undercooled liquid regions," *Scripta Materialia*, vol. 43, No. 2, 2000, pp. 109-114.

(Continued)

*Primary Examiner* — George Wyszomierski
(74) *Attorney, Agent, or Firm* — Polsinelli PC

(57) ABSTRACT

An alloy comprising Fe, Ni, P, B and Ge is disclosed, having a composition according to the formula $[Fe_{1-y}Ni_y]_{(100-a-b-c)}P_aB_bGe_c$, where a, b, c subscripts denote atomic percent; y subscript denotes atomic fraction, a is between 9 and 12, b is between 5.5 and 7.5, c is between 2 and 6, and y is between 0.45 and 0.55. Metallic glass rods with diameter of at least 1 mm can be formed from the alloy by rapid quenching from the molten state.

20 Claims, 8 Drawing Sheets

(56) References Cited

U.S. PATENT DOCUMENTS

| | | | | |
|---|---|---|---|---|
| 4,968,363 | A | 11/1990 | Hashimoto et al. | |
| 5,429,725 | A | 7/1995 | Thorpe et al. | |
| 5,634,989 | A | 6/1997 | Hashimoto et al. | |
| 6,325,868 | B1 | 12/2001 | Kim et al. | |
| 8,287,664 | B2 * | 10/2012 | Brunner | B22F 9/002 148/104 |
| 2005/0263216 | A1 * | 12/2005 | Chin | C22C 45/02 148/304 |
| 2009/0110955 | A1 | 4/2009 | Hartmann et al. | |
| 2012/0073710 | A1 | 3/2012 | Kim et al. | |
| 2012/0168037 | A1 | 7/2012 | Demetriou et al. | |
| 2013/0048152 | A1 | 2/2013 | Na et al. | |
| 2014/0238551 | A1 | 8/2014 | Na et al. | |
| 2015/0047755 | A1 | 2/2015 | Na et al. | |
| 2015/0159242 | A1 | 6/2015 | Na et al. | |
| 2015/0176111 | A1 | 6/2015 | Na et al. | |
| 2015/0240336 | A1 | 8/2015 | Na et al. | |

FOREIGN PATENT DOCUMENTS

| | | |
|---|---|---|
| DE | 102011001783 | 10/2012 |
| EP | 0014335 | 8/1980 |
| EP | 0161393 | 11/1985 |
| EP | 0260706 | 3/1988 |
| EP | 1108796 | 6/2001 |
| EP | 1522602 | 4/2005 |
| JP | 54-76423 | 6/1979 |
| JP | S55-148752 | 11/1980 |
| JP | S57-13146 | 1/1982 |
| JP | 63-079930 | 4/1988 |
| JP | 63079931 | 4/1988 |
| JP | 63-277734 | 11/1988 |
| JP | 1-205062 | 8/1989 |
| JP | 08-269647 | 10/1996 |
| JP | 11-71659 | 3/1999 |
| JP | 2001-049407 | 2/2001 |
| WO | WO 2012/053570 | 4/2012 |
| WO | WO 2013/028790 | 2/2013 |

OTHER PUBLICATIONS

Mitsuhashi A. et al., "The corrosion behavior of amorphous nickel base alloys in a hot concentrated phosphoric acid," *Corrosion Science*, vol. 27, No. 9, 1987, pp. 957-970.

Kawashima A. et al., "Change in corrosion behavior of amorphous Ni-P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy $Ni_{70}Mo_{10}P_{20}$," *Physics of the Solid State*, vol. 40., No. 9, 1998, pp. 1429-1432.

Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF-Series of Ni—Cr—B—Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," *Materials Science and Engineering A*, vol. 499, No. 1-2, 2009, pp. 114-117.

Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.

Habazaki et al., "Corrosion behaviour of amorphous Ni—Cr—Nb—P—B bulk alloys in 6M HCI solution," *Material Science and Engineering*, A318, 2001, pp. 77-86.

Murakami (Editor), *Stress Intensity Factors Handbook*, vol. 2, Oxford: Pergamon Press, 1987, 4 pages.

Yokoyama et al., "Viscous Flow Workability of Ni—Cr—P—B Metallic Glasses Produced by Melt-Spinning in Air," *Materials Transactions*, vol. 48, No. 12, 2007, pp. 3176-3180.

Habazaki et al., "Preparation of corrosion-resistant amorphous Ni—Cr—P—B bulk alloys containing molybdenum and tantalum," *Material Science and Engineering*, A304-306, 2001, pp. 696-700.

Zhang et al., "The Corrosion Behavior of Amorphous Ni—Cr—P Alloys in Concentrated Hydrofluoric Acid," *Corrosion Science*, vol. 33, No. 10, pp. 1519-1528, 1992.

Katagiri et al., "An attempt at preparation of corrosion-resistant bulk amorphous Ni—Cr—Ta—Mo—P—B alloys," *Corrosion Science*, vol. 43, No. 1, pp. 183-191, 2001.

* cited by examiner

BULK IRON-NICKEL GLASSES BEARING PHOSPHORUS-BORON AND GERMANIUM

CROSS-REFERENCE TO RELATED APPLICATIONS

The application claims priority to U.S. Provisional Patent Application No. 61/725,394, entitled "Bulk Iron-Nickel Glasses Bearing Phosphorus-Boron and Germanium", filed on Nov. 12, 2012, which is incorporated herein by reference in its entirety.

TECHNICAL FIELD

The disclosure is directed to Fe—Ni—P—B—Ge alloys capable of forming bulk metallic glass rods with diameters greater than 1 mm and up to 4 mm or larger.

BACKGROUND

Metal alloys which are most easily obtained in the amorphous state by rapid quenching from the melt state are mixtures of transition metals with metalloids, i.e. semimetals. U.S. Pat. No. 4,144,058 by Chen et al discloses iron (Fe)-nickel (Ni) alloys bearing phosphorus (P) and boron (B) having compositions that vary over a very broad range capable of forming metallic glasses in the form of sheets, ribbons, or powders with lateral dimensions on the order of tens of micrometers. Chen et al mentions that additions of aluminum (Al), silicon (Si), tin (Sn), antimony (Sb), indium (In), Beryllium (Be), as well as germanium (Ge) within the range of up to 15 atomic percent were found to form such micrometer thick sheets, ribbons or powders. However, Chen et al provides no example of an Fe—Ni—P—B—Ge alloy.

Generally, there may be a small range of compositions surrounding each of the known metallic glass forming compositions where the amorphous state can be obtained in bulk form by rapid quenching from the melt state, that is, to be formed in millimeter size objects rather than micrometer size objects. No practical guidelines are known for predicting with certainty the precise compositional ranges that will encompass bulk metallic glass forming alloys that are "significantly better" glass formers than the marginal glass formers generally found over much broader compositional ranges (e.g. those disclosed by Chen et al). In fact, no practical guideline is known for predicting whether such a narrow range of bulk metallic glass forming alloys will even exist within the very broad range of marginal metallic glass forming alloys.

Due to the attractive engineering properties of Fe—Ni based P and B bearing bulk glasses, such as high strength, high toughness, bending ductility, and corrosion resistance, there remains a need to develop alloys with comparable engineering performance but with significantly improved glass-forming ability such that bulk engineering components can be produced.

BRIEF SUMMARY

In the present disclosure, Fe—Ni—P—B—Ge alloys and metallic glasses are disclosed. Metallic glass rods with diameters up to several millimeters can be formed from the disclosed alloys. The identity of this narrow composition range or even its existence has not been previously disclosed. In various embodiments, Fe—Ni—P—B—Ge alloys containing Ge in concentrations ranging from 2 atomic percent to 6 atomic percent, and demonstrate significantly better glass forming ability than Fe—Ni—P—B alloys that are free of Ge.

In one embodiment, the disclosure is directed to a metallic glass or an alloy represented by the following formula (a, b, and c subscripts denote atomic percent; y subscript denotes atomic fraction) in Equation (1):

$$[Fe_{1-y}Ni_y]_{(100-a-b-c)}P_aB_bGe_c \quad \text{Eq. (1)}$$

where:

an atomic percent of P a is between 9 and 12, an atomic percent of B b is between 5.5 and 7.5, an atomic percent of Ge c is between 2 and 6, and an atomic fraction y is between 0.45 and 0.55. Metallic glass rods having a diameter of at least 1 mm can be formed by rapid quenching such metallic glasses from the molten state.

In another embodiment, a+b+c is between 21 and 23, and wherein metallic glass rods having a diameter of at least 2 mm can be formed by rapid quenching such metallic glasses from the molten state.

In yet another embodiment, y is between 0.475 and 0.525, and wherein metallic glass rods having a diameter of at least 2 mm can be formed by rapid quenching such metallic glasses from the molten state.

In yet another embodiment, a is between 10 and 11.5, and wherein metallic glass rods having a diameter of at least 2 mm can be formed by rapid quenching such metallic glasses from the molten state.

In yet another embodiment, b is between 6 and 7, and wherein metallic glass rods having a diameter of at least 2 mm can be formed by rapid quenching such metallic glasses from the molten state.

In yet another embodiment, c is between 4 and 5.5, and wherein metallic glass rods having a diameter of at least 2 mm can be formed by rapid quenching such metallic glasses from the molten state.

In yet another embodiment, up to 5 atomic percent of Fe, Ni, or both is substituted by Co.

In yet another embodiment, up to 2.5 atomic percent of Ni, Fe, or both is substituted by Cr, Ru, Pd, or combinations thereof.

In yet another embodiment, up to 2.5 atomic percent of P, Ge, or both is substituted by Sn, Si, Sb, or combinations thereof.

In yet another embodiment, up to 2.5 atomic percent of B is substituted by C.

In yet another embodiment, the melt is fluxed with a reducing agent prior to rapid quenching.

In yet another embodiment, the reducing agent is boron oxide ($B_2O_3$).

In yet another embodiment, the temperature of the melt prior to quenching is at least 100 degrees above the liquidus temperature of the alloy.

In yet another embodiment, the temperature of the melt prior to quenching is at least 1100° C.

In yet another embodiment, a bulk ferromagnetic core can be formed from the alloys and used in a product selected from the group consisting of inductors, transformers, clutches, and DC/AC converters.

In some embodiments, the disclosure is also directed to metallic glass compositions or alloy compositions $Fe_{39}Ni_{39}P_{11}B_{6.6}Ge_{4.4}$, $Fe_{38.9}Ni_{39.1}P_{11}B_{6.6}Ge_{4.4}$, $Fe_{38.8}Ni_{39.2}P_{11}B_{6.6}Ge_{4.4}$, $Fe_{38.7}Ni_{39.3}P_{11}B_{6.6}Ge_{4.4}$, $Fe_{38.6}Ni_{39.4}P_{11}B_{6.6}Ge_{4.4}$, $Fe_{38.7}Ni_{39.3}P_{11.2}B_{6.6}Ge_{4.2}$, $Fe_{38.7}Ni_{39.3}P_{10.8}B_{6.6}Ge_{4.6}$, $Fe_{38.7}Ni_{39.3}P_{10.4}B_{6.6}Ge_5$, $Fe_{38.7}Ni_{39.3}P_{10.3}B_{6.6}Ge_{5.1}$, $Fe_{38.7}Ni_{39.3}P_{10.6}B_{6.6}Ge_{5.4}$, $Fe_{38.7}Ni_{39.3}P_{10.3}B_{6.7}Ge_5$, $Fe_{38.7}Ni_{39.3}P_{10.5}B_{6.5}Ge_5$, $Fe_{38.8}Ni_{39.4}P_{10.2}B_{6.7}Ge_5$, and $Fe_{38.6}Ni_{39.2}P_{10.6}B_{6.7}Ge_5$.

DETAILED DESCRIPTION

The disclosure may be understood by reference to the following detailed description, taken in conjunction with the drawings as described below. It is noted that, for purposes of illustrative clarity, certain elements in various drawings may not be drawn to scale.

Description of Alloy Compositions

In accordance with the provided disclosure and drawings, Fe—Ni—P—B—Ge alloys are provided within a well-defined composition range. These alloys can form metallic glass rods with diameters greater than at least 1 mm. Specifically, by controlling the relative concentrations of Ge to be from 2 to 6 atomic percent, the amorphous phase of these alloys can be formed into metallic glass rods with diameters greater than at least 1 mm.

The disclosure provides alloys that have a good glass forming ability. The Fe—Ni—P—B—Ge alloys capable of forming metallic glasses rods with diameters of up to 4 mm or larger have significantly better glass forming ability than the metallic glasses disclosed in U.S. Pat. No. 4,144,058 by Chen et al, which were capable of forming metallic wires with diameters of only about 100 micrometers.

In the present disclosure, the glass-forming ability of each alloy is quantified by the "critical rod diameter", defined as maximum rod diameter in which the amorphous phase can be formed when processed by a method of water quenching a quartz tube with 0.5 m thick walls containing a molten alloy.

In some aspects, the "critical cooling rate" defined as the cooling rate required to avoid crystallization and form the amorphous phase of the alloy (i.e. the metallic glass) depends on the composition of the alloys. The lower the critical cooling rate of an alloy, the larger its critical rod diameter would be. The critical cooling rate $R_c$ in K/s and critical rod diameter $d_c$ in mm are known in the art to be related via the following empirical Equation:

$$R_c=1000/d_c^2 \qquad \text{Eq. (2)}$$

According to Eq. (2), the critical cooling rate for an alloy having a critical rod diameter of about 0.1 mm, such as the one disclosed by Chen et al., is about 100,000 K/s. On the other hand, the critical cooling rate for an alloy having a critical rod diameter of about 4 mm, as in the case of the alloys according to embodiments of the present disclosure, is only about 60 K/s. Therefore, forming the metallic glass phase from the alloys according to the present disclosure requires cooling rates that are more than three orders of magnitude lower than the alloys of the Chen et al. disclosure. This suggests that the alloys according to the present disclosure unexpectedly demonstrate a glass forming ability that is considerably better than the alloys according to the Chen et al. patent.

Figure 1:
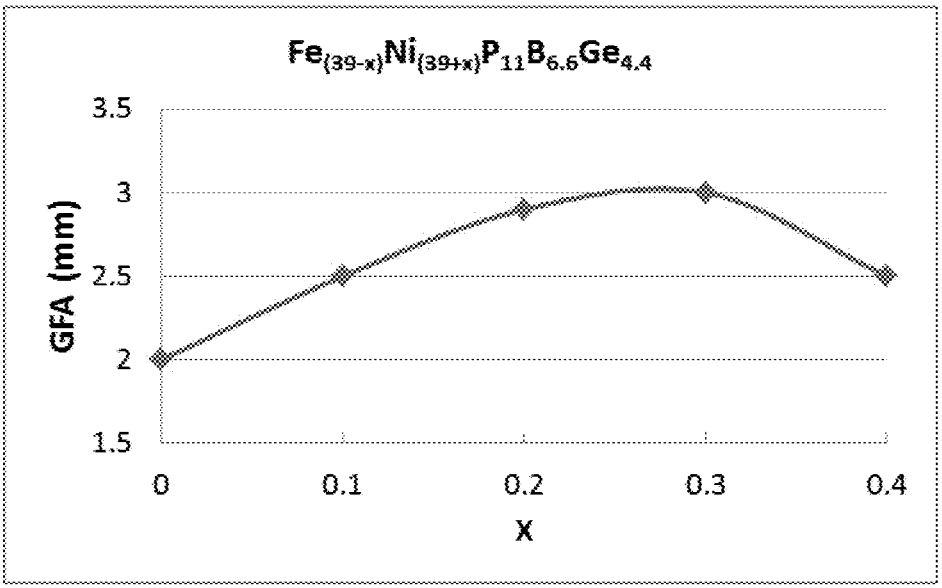
FIG. 1 provides a data plot showing the effect of substituting Fe by Ni according to the formula $Fe_{39-x}Ni_{39+x}P_{11}B_{6.6}Ge_{4.4}$ on the glass forming ability of Fe—Ni—P—B—Ge alloys in accordance with embodiments of the disclosure.

Specific embodiments of Fe—Ni—P—B—Ge alloys and metallic glasses demonstrating the effect on glass forming ability of increasing the Ni atomic concentration by substituting Fe according to the formula $Fe_{39-x}Ni_{39+x}P_{11}B_{6.6}Ge_{4.4}$ are presented in Table 1, and are plotted in FIG. 1. Example metallic glasses 1-5 have a Ge concentration of 4.4 atomic percent, a B concentration of 6.6 atomic percent, a P concentration of 11 atomic percent, and the Fe concentration is varied from 38.6 to 39.0 atomic percent while Ni is varied from 39.0 to 39.4 atomic percent. The data suggests that bulk-glass formation is possible over a narrow range of Fe and Ni concentrations. Specifically, formation of metallic glass rods with diameters greater than 2 mm is possible for an atomic fraction y ranging between about 0.5 and 0.505, according to Eq. (1), when the total atomic concentration of P, B, and Ge (a+b+c) is fixed at about 22.

TABLE 1

Example metallic glasses demonstrating the effect of substituting Fe by Ni on the glass forming ability of Fe—Ni—P—B—Ge alloys

| Example | Composition | Critical Rod Diameter (mm) |
|---|---|---|
| 1 | $Fe_{39.0}Ni_{39.0}P_{11}B_{6.6}Ge_{4.4}$ | 2 |
| 2 | $Fe_{38.9}Ni_{39.1}P_{11}B_{6.6}Ge_{4.4}$ | 2.5 |
| 3 | $Fe_{38.8}Ni_{39.2}P_{11}B_{6.6}Ge_{4.4}$ | 2.9 |
| 4 | $Fe_{38.7}Ni_{39.3}P_{11}B_{6.6}Ge_{4.4}$ | 3 |
| 5 | $Fe_{38.6}Ni_{39.4}P_{11}B_{6.6}Ge_{4.4}$ | 2.5 |

It was also found that when y is between 0.475 and 0.525, metallic glass rods of diameter of at least 2 mm can be formed. It was further found that formation of metallic glass rods having diameters of at least 1 mm is possible over a broader range of an atomic fraction y from about 0.45 to about 0.55.

FIG. 1 provides a data plot for Table 1 showing the effect of increasing the Ni atomic concentration by substituting Fe on the glass forming ability of the Fe—Ni—P—B—Ge alloys according to the formula $Fe_{39-x}Ni_{39+x}P_{11}B_{6.6}Ge_{4.4}$. As shown in both Table 1 and FIG. 1, a peak in glass forming ability at x=0.3 is identified, enabling formation of metallic glass rods with diameters of up to 3 mm. According to Eq. 1, the composition with x=0.3 demonstrating the highest glass forming ability is associated with an atomic fraction y of about 0.5038.

Figure 2:
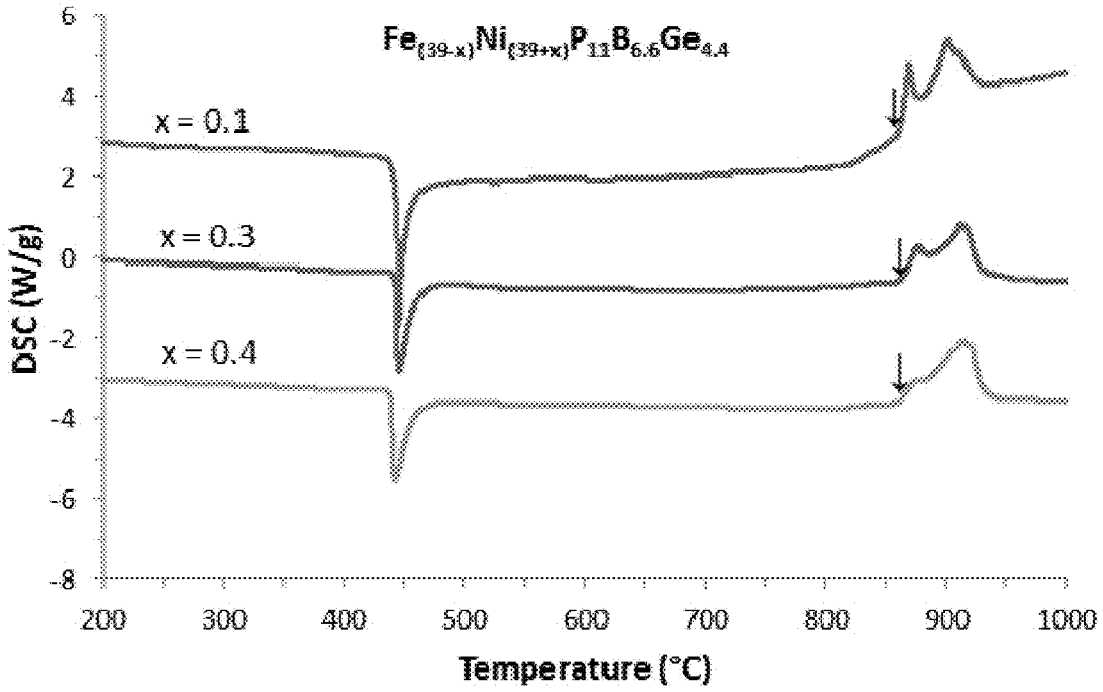
FIG. 2 provides calorimetry scans for Fe—Ni—P—B—Ge metallic glasses from Table 1 with varying Fe and Ni atomic concentrations according to the formula $Fe_{39-x}Ni_{39+x}P_{11}B_{6.6}Ge_{4.4}$ (arrows designate the liquidus temperatures).

Differential calorimetry scans corresponding to example metallic glasses listed in Table 2 are presented in FIG. 2. The differential calorimetry scans of the metallic glasses reveal that the liquidus temperatures pass through a shallow minimum at x of 0.3, where the atomic percent of Ni is 39.3, and where the peak in glass forming ability is observed as shown in FIG. 1.

Example metallic glasses demonstrating the effect of substituting P by Ge according to the formula $Fe_{38.7}Ni_{39.3}P_{11.2-x}B_{6.6}Ge_{4.2+x}$ on the glass forming ability of the Fe—Ni—P—B—Ge alloys are presented in Table 2. Example metallic glasses 6-10 have an Fe concentration of 38.7 atomic percent, a Ni concentration of 39.3 atomic percent, a B concentration of 6.6 atomic percent, and varying Ge and P concentrations. The data suggests that bulk metallic glass formation, such as metallic glass rods with diameters greater than 2.5 mm, is possible when c in Eq. (1) ranges between about 4.2 and 5.4, and when a total concentration of P, B, and Ge (a+b+c) is fixed at about 22.

TABLE 2

Example metallic glasses demonstrating the effect of substituting P by Ge on the glass forming ability of Fe—Ni—P—B—Ge alloys

| Example | Composition | Critical Rod Diameter (mm) |
|---|---|---|
| 6 | $Fe_{38.7}Ni_{39.3}P_{11.2}B_{6.6}Ge_{4.2}$ | 2.5 |
| 4 | $Fe_{38.7}Ni_{39.3}P_{11}B_{6.6}Ge_{4.4}$ | 3 |
| 7 | $Fe_{38.7}Ni_{39.3}P_{10.8}B_{6.6}Ge_{4.6}$ | 3.6 |
| 8 | $Fe_{38.7}Ni_{39.3}P_{10.4}B_{6.6}Ge_{5}$ | 4 |
| 9 | $Fe_{38.7}Ni_{39.3}P_{10.3}B_{6.6}Ge_{5.1}$ | 3.5 |
| 10 | $Fe_{38.7}Ni_{39.3}P_{10.6}B_{6.6}Ge_{5.4}$ | 3 |

Figure 3:
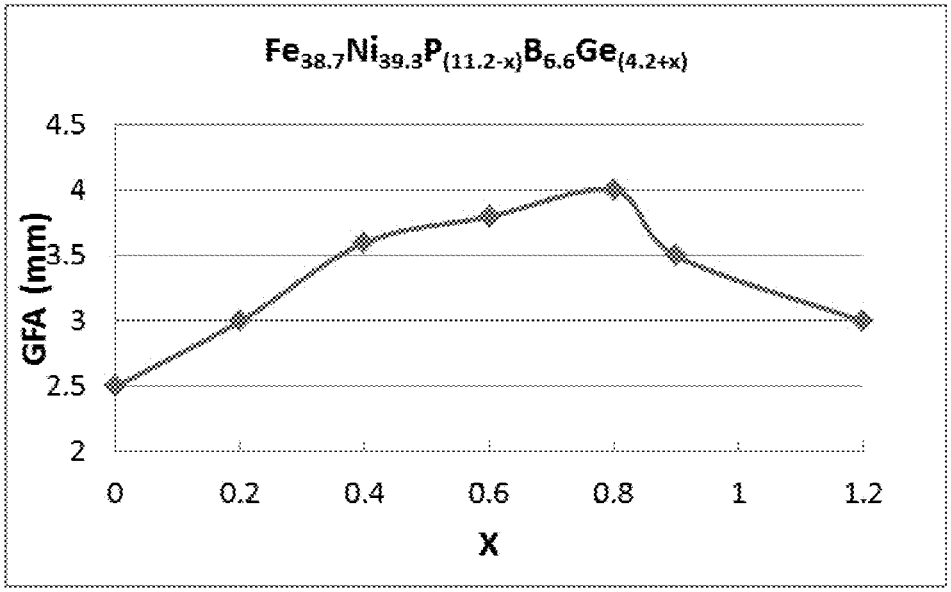
FIG. 3 provides a data plot showing the effect of substituting P by Ge according to the formula $Fe_{38.7}Ni_{39.3}P_{11.2-x}B_{6.6}Ge_{4.2+x}$ on the glass forming ability of Fe—Ni—P—B—Ge alloys in accordance with embodiments of the disclosure.
Figure 4:
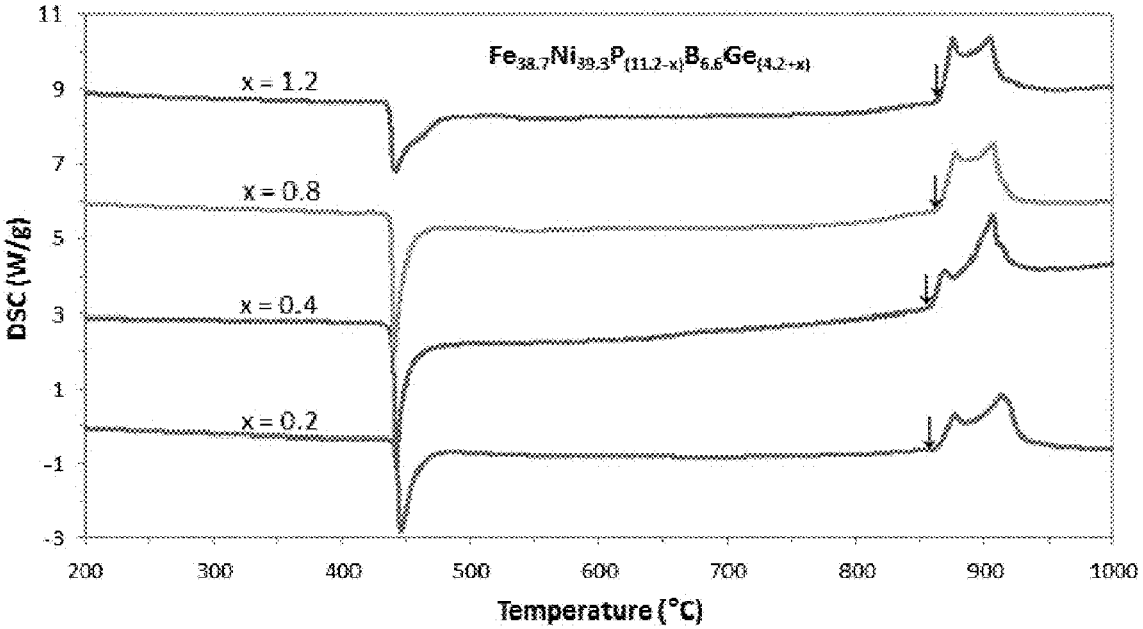
FIG. 4 provides calorimetry scans for example metallic glasses Fe—Ni—P—B—Ge from Table 2 with varying P and Ge atomic concentrations according to the formula $Fe_{38.7}Ni_{39.3}P_{11.2-x}B_{6.6}Ge_{4.2+x}$ (arrows designate the liquidus temperatures) in accordance with embodiments of the disclosure.

FIG. 3 provides a data plot for Table 2 showing the effect of substituting P by Ge according to the formula $Fe_{38.7}Ni_{39.3}P_{11.2-x}B_{6.6}Ge_{4.2+x}$ on the glass forming ability of the Fe—Ni—P—B—Ge alloys in accordance with embodiments of the disclosure. As shown in both Table 2 and FIG. 3, a peak in glass forming ability at x=0.8, corresponding to a Ge concentration c of about 5 (Example metallic glass 8), is identified, enabling formation of metallic glass rods with diameters of up to 4 mm. Differential calorimetry scans of example metallic glasses listed in Table 2 and plotted in FIG. 3 are presented in FIG. 4.

It was found that formation of metallic glass rods with critical rod diameters of at least 1 mm is possible over a broader range of Ge concentration, c, from about 2 to about 6. Alloys with such narrow composition range demonstrate surprisingly higher glass forming ability than alloys with compositions outside this narrow Ge range. For example, the critical rod diameter is much less than 1 mm when c is less than 2 atomic percent or greater than 6 atomic percent. It was also found that when c is between 4 and 5.5, metallic glass rods with diameters of at least 2 mm can be formed by rapid quenching from the molten state.

Figure 5:
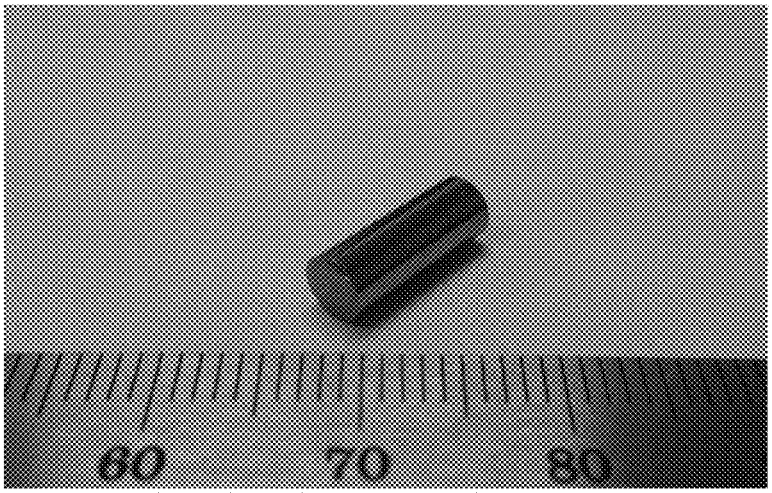
FIG. 5 provides an image of an amorphous 4 mm rod of example metallic glass $Fe_{38.7}Ni_{39.3}P_{10.4}B_{6.6}Ge_5$ in accordance with embodiments of the disclosure.
Figure 6:
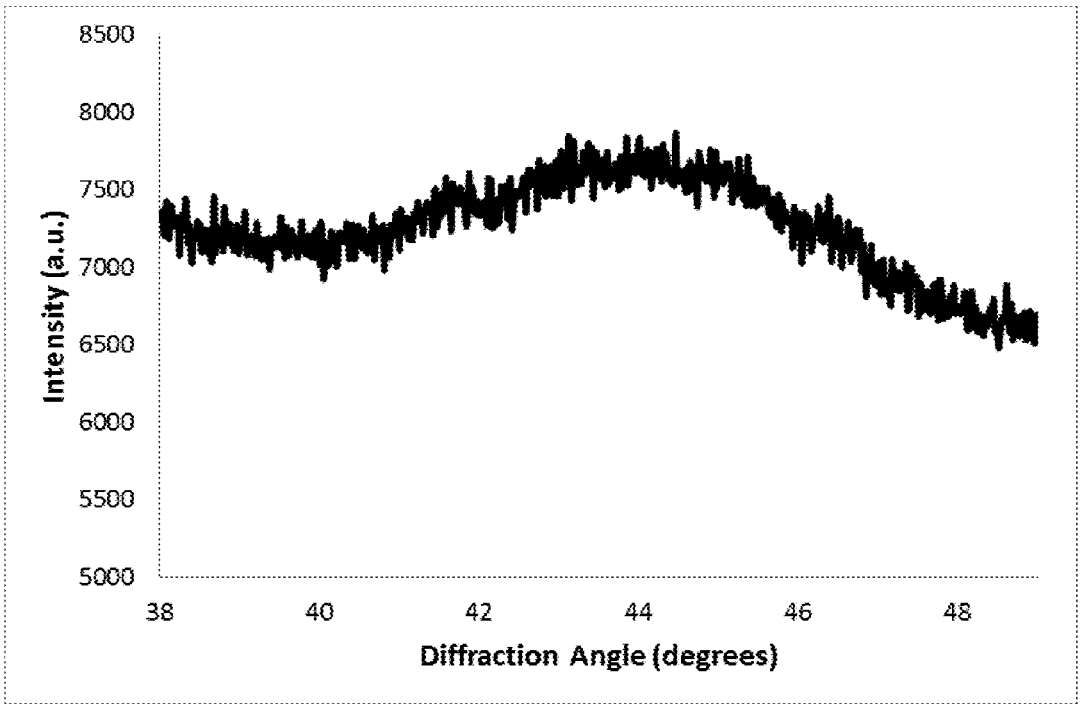
FIG. 6 provides an X-ray diffractogram verifying the amorphous structure of a 4 mm rod of example metallic glass $Fe_{38.7}Ni_{39.3}P_{10.4}B_{6.6}Ge_5$ in accordance with embodiments of the disclosure.

An image of a 4 mm diameter rod of metallic glass $Fe_{38.7}Ni_{39.3}P_{10.4}B_{6.6}Ge_{5}$ is presented in FIG. 5, and an x-ray diffractogram verifying its amorphous structure is presented in FIG. 6.

Figure 7:
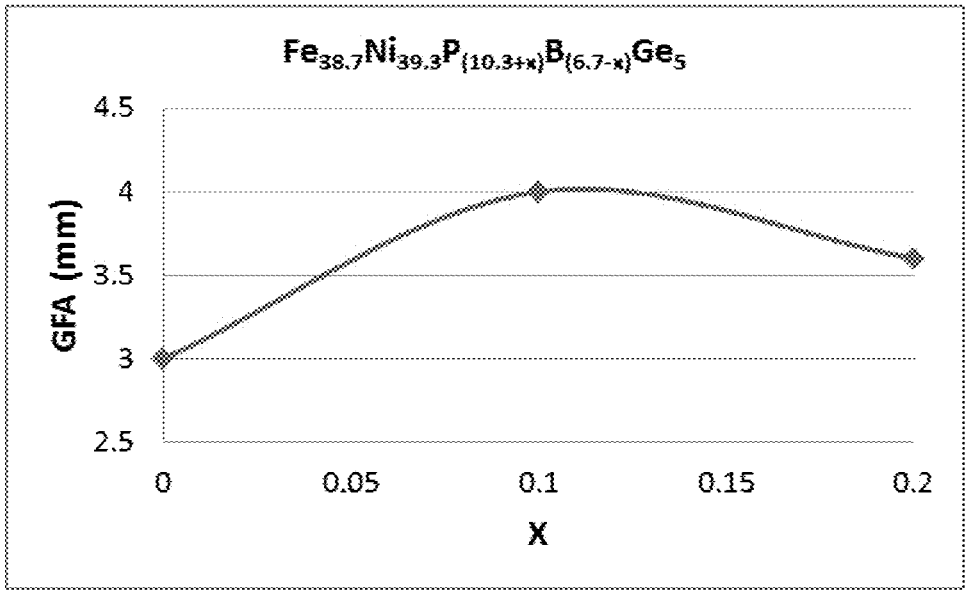
FIG. 7 provides a data plot showing the effect of P by B according to the formula $Fe_{38.7}Ni_{39.3}P_{19.3+x}B_{6.7-x}Ge_5$ on the glass forming ability of the Fe—Ni—P—B—Ge alloys in accordance with embodiments of the disclosure.

Example metallic glasses demonstrating the effect of substituting P by B according to the formula $Fe_{38.7}Ni_{39.3}P_{19.3+x}B_{6.7+x}Ge_{5}$ on the glass forming ability of the Fe—Ni—P—B—Ge alloys are presented in Table 3, and are plotted in FIG. 7. Example metallic glasses 8, 11, and 12 have Fe composition of 38.7 atomic percent, Ni composition of 39.3 atomic percent, Ge concentration of 5 atomic percent, and varying B and P concentrations. The data suggests that bulk-glass formation, wherein metallic glass rods with diameters greater than 3 mm can be formed, is possible when B concentration, b, in Eq. (1) ranges between about 6.5 and 6.7, and when a+b+c is fixed at about 22. A peak in glass forming ability at a b of about 6.6 is identified, enabling formation of metallic glass rods with diameters of up to 4 mm.

TABLE 3

Example metallic glasses demonstrating the effect of substituting P by B on the glass forming ability of Fe—Ni—P—B—Ge alloys

| Example | Composition | Critical Rod Diameter (mm) |
|---|---|---|
| 11 | $Fe_{38.7}Ni_{39.3}P_{10.3}B_{6.7}Ge_{5}$ | 3 |
| 8 | $Fe_{38.7}Ni_{39.3}P_{10.4}B_{6.6}Ge_{5}$ | 4 |
| 12 | $Fe_{38.7}Ni_{39.3}P_{10.5}B_{6.5}Ge_{5}$ | 3.6 |

It was found that formation of metallic glass rods with at least 1 mm diameter is possible over a range of B concentration, b, from about 5.5 to about 7.5. Alloys within such narrow composition range demonstrate surprisingly higher glass forming ability than alloys with compositions outside this range of B. It was also found that when b is between 6 and 7, metallic glass rods of diameter of at least 2 mm can be formed by rapid quenching from the molten state.

Figure 8:
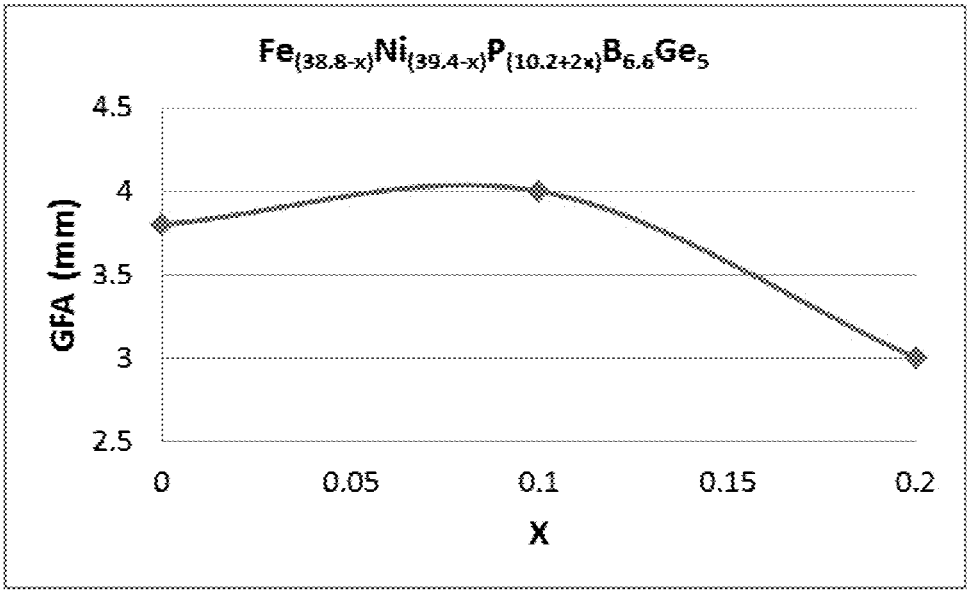
FIG. 8 provides a data plot showing the effect of substituting both Fe and Ni by P according to the formula $Fe_{38.8-x}Ni_{39.4-x}P_{10.2+2x}B_{6.6}Ge_5$ on the glass forming ability of the Fe—Ni—P—B—Ge alloys in accordance with embodiments of the disclosure.

Example metallic glasses demonstrating the effect of increasing the P atomic concentration by substituting both Fe and Ni according to the formula $Fe_{38.8-x}N_{39.4-x}P_{10.2+2x}B_{6.6}Ge_{5}$ on the glass forming ability of the Fe—Ni—P—B—Ge alloys are presented in Table 4, and are plotted in FIG. 8. Example metallic glasses 8, 11, and 12 have a Ge concentration of 5 atomic percent, a B concentration of 6.6 atomic percent, and varying Fe, Ni, and P concentrations. As shown in both Table 4 and FIG. 8, a peak in glass forming ability at c of about 5 (Example metallic glass 8) is identified, enabling formation of metallic glass rods with diameters of 4 mm. The data also shows that metallic glass rods with diameters greater than 3 mm can be formed when a in Eq. (1) ranges between about 10.2 and 10.6, and when the total concentration of B and Ge (b+c) is fixed at about 11.6.

TABLE 4

Example metallic glasses demonstrating the effect of substituting both Fe and Ni by P on the glass forming ability of Fe—Ni—P—B—Ge alloys

| Example | Composition | Critical Rod Diameter (mm) |
|---|---|---|
| 13 | $Fe_{38.8}Ni_{39.4}P_{10.2}B_{6.6}Ge_{5}$ | 3.8 |
| 8 | $Fe_{38.7}Ni_{39.3}P_{10.4}B_{6.6}Ge_{5}$ | 4 |
| 14 | $Fe_{38.6}Ni_{39.2}P_{10.6}B_{6.6}Ge_{5}$ | 3 |

It was found that when a is between 10 and 11.5, metallic glass rods with diameters of at least 2 mm can be formed by rapid quenching from the molten state. It was also found that formation of metallic glass rods with diameters of at least 1 mm is possible over a broader range of a, from about 9 to about 12. Alloys within such a narrow composition range demonstrate surprisingly higher glass forming ability than alloys with compositions outside the P range of 9 to 12 atomic percent.

The effect of fluxing the alloys with boron oxide ($B_2O_3$) prior to rapidly quenching to form the metallic glass rods is also investigated. Fluxing is a chemical process by which the fluxing agent acts to "reduce" the oxides entrained in the glass-forming alloy that could potentially impair glass formation by catalyzing crystallization. Whether fluxing is beneficial in promoting glass formation is determined by the chemistry of the alloy and the fluxing agent. For the chemistry of the alloys described herein, fluxing with $B_2O_3$ was determined to dramatically improve bulk-glass formation. All data shown in Tables 1-4, and FIGS. 1, 3, 7, and 8 were produced using alloys that have been processed by fluxing. Fluxing with $B_2O_3$ was not disclosed previously by Chen et al.

As an example, alloy composition $Fe_{38.7}Ni_{39.3}P_{10.4}B_{6.6}Ge_5$ is capable of forming metallic glass rods with diameters of up to 4 mm when fluxed with $B_2O_3$. Without fluxing, the alloy was found to be incapable of forming metallic glass rods of at least 1 mm in diameter. The fluxing results are presented in Table 5. As shown, fluxing promotes bulk metallic glass formation.

TABLE 5

Example metallic glasses demonstrating the effect of fluxing on the glass forming ability of the Fe—Ni—P—B—Ge alloys

| Example | Composition | Critical Rod Diameter (mm) |
|---|---|---|
| 8 | $Fe_{38.7}Ni_{39.3}P_{10.4}B_{6.6}Ge_5$ (fluxed) | 4 |
| 8 | $Fe_{38.7}Ni_{39.3}P_{10.4}B_{6.6}Ge_5$ (unfluxed) | <1 |

In some embodiments, up to 5 atomic percent of either Fe or Ni or both is substituted by Co. In some embodiments, up to 2.5 atomic percent of either Ni or Fe or both is substituted by Cr, Ru, Pd, or combinations thereof. In some embodiments, up to 2.5 atomic percent of either P, Ge, or both is substituted by Sn, Si, Sb, or combinations thereof. In some embodiments, up to 2.5 atomic percent of B is substituted by C.

Description of Methods of Forming Alloy Compositions and Metallic Glass Articles A method for producing the alloyed ingots of the disclosure involves inductive melting of the appropriate amounts of elemental constituents in a quartz tube under inert atmosphere. The purity levels of the constituent elements were as follows: Fe 99.95%, Ni 99.995%, B 99.5%, P 99.9999%, and Ge 99.999%. In some embodiments, the alloyed ingots are fluxed with dehydrated boron oxide ($B_2O_3$) by re-melting the ingots in a quartz tube under inert atmosphere, bringing the alloy melt in contact with the boron oxide melt and allowing the two melts to interact for at least 500 s at a temperature of at least 1100° C., and subsequently water quenching.

A method for producing metallic glass rods from the alloys of the disclosure involves re-melting the alloyed ingots in cylindrical quartz tubes with 0.5 mm thick walls in a furnace at temperature between 1150 and 1250° C. under high purity argon and rapidly quenching in a room-temperature water bath.

Optionally, amorphous articles can also be produced from the alloy of the disclosure by re-melting the alloyed ingots in a crucible made of a material that includes, without limitation, quartz, graphite, alumina, and/or zirconia, and injecting or pouring the molten alloy into a metal mold made of a material that includes, without limitation, copper, brass, and/or steel.

Optionally, prior to producing an amorphous article, the alloyed ingots can be fluxed with a reducing agent (e.g. $B_2O_3$) by re-melting the ingots in a quartz tube under inert atmosphere, bringing the alloy melt in contact with the molten reducing agent, and allowing the two melts to interact for about 1000 s at a temperature of about 1200° C. or higher, under inert atmosphere and subsequently water quenching.

Test Methodology for Assessing Glass-Forming Ability

The glass-forming ability of each alloy was assessed by determining the maximum rod diameter in which the amorphous phase of the alloy (i.e. the metallic glass phase) could be formed when processed by the method described above. X-ray diffraction with Cu-Kα radiation was performed to verify the amorphous structure of the alloys.

Test Methodology for Differential Scanning Calorimetry

Differential scanning calorimetry was performed on sample metallic glasses at a scan rate of 20 K/min to determine the glass-transition, crystallization, solidus, and liquidus temperatures of sample metallic glasses.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. An alloy comprising $[Fe_{1-y}Ni]_{(100-a-b-c)}P_aB_bGe_c$ wherein:
the atomic percent of P a is between 9 and 12,
the atomic percent of B b is between 5.5 and 7.5,
the atomic percent of Ge c is between 2 and 6, and
the atomic fraction y is between 0.45 and 0.55,
and wherein the alloy is capable of forming a metallic glass rod having a diameter of at least 1 mm.

2. The alloy of claim 1, wherein a+b+c is between 21 and 23, and wherein the alloy is capable of forming a metallic glass rod having a diameter of at least 2 mm.

3. The alloy of claim 1, wherein y is between 0.475 and 0.525, and wherein the alloy is capable of forming a metallic glass rod having a diameter of at least 2 mm.

4. The alloy of claim 1, wherein a is between 10 and 11.5, and wherein the alloy is capable of forming a metallic glass rod having a diameter of at least 2 mm.

5. The alloy of claim 1, wherein b is between 6 and 7, and wherein the alloy is capable of forming a metallic glass rod having a diameter of at least 2 mm.

6. The alloy of claim 1, wherein c is between 4 and 5.5, and wherein the alloy is capable of forming a metallic glass rod having a diameter of at least 1 mm.

7. The alloy of claim 1, further comprising up to 5 atomic percent of Co in substitution of a species selected from the group consisting of Fe, Ni, or both.

8. The alloy of claim 1, further comprising up to 2.5 atomic percent of Cr, Ru, Pd, or combinations in substitution of a species selected from the group consisting of Ni, Fe, or both.

9. The alloy of claim 1, further comprising up to 2.5 atomic percent of Sn, Si, Sb, or combinations in substitution of a species selected from the group consisting of P, Ge, or both.

10. The alloy of claim 1, further comprising up to 2.5 atomic percent of C in substitution of B.

11. A metallic glass comprising the alloy of claim 1.

12. A product comprising the metallic glass of claim 11, wherein the product is selected from the group consisting of inductors, transformers, clutches, and DC/AC converters.

13. An alloy comprising a composition selected from a group consisting of $Fe_{39}Ni_{39}P_{11}B_{6.6}Ge_{4.4}$, $Fe_{38.9}Ni_{39.1}P_{11}B_{6.6}Ge_{4.4}$, $Fe_{38.8}Ni_{39.2}P_{11}B_{6.6}Ge_{4.4}$, $Fe_{38.7}Ni_{39.3}P_{11}B_{6.6}Ge_{4.4}$, $Fe_{38.6}Ni_{39.4}P_{11}B_{6.6}Ge_{4.4}$, $Fe_{38.7}Ni_{39.3}P_{11.2}B_{6.6}Ge_{4.2}$, $Fe_{38.7}Ni_{39.3}P_{10.8}B_{6.6}Ge_{4.6}$, $Fe_{38.7}Ni_{39.3}P_{10.4}B_{6.6}Ge_{5}$, $Fe_{38.7}Ni_{39.3}P_{10.3}B_{6.6}Ge_{5.1}$, $Fe_{38.7}Ni_{39.3}P_{10.6}B_{6.6}Ge_{5.4}$, $Fe_{38.7}Ni_{39.3}P_{10.3}B_{6.7}Ge_{5}$, $Fe_{38.7}Ni_{39.3}P_{10.5}B_{6.5}Ge_{5}$, $Fe_{38.8}Ni_{39.4}P_{10.2}B_{6.7}Ge_{5}$, and $Fe_{38.6}Ni_{39.2}P_{10.6}B_{6.7}Ge_{5}$, wherein the alloy is capable of forming a metallic glass rod having a diameter of at least 1 mm.

14. A method for processing an alloy to form an object of metallic glass, the method comprising:

melting an alloy comprising $[Fe_{1-y}Ni_{y}]_{(100-a-b-c)}P_aB_bGe_c$, wherein the atomic percent of P a is between 9 and 12, the atomic percent of B b is between 5.5 and 7.5, the atomic percent of Ge c is between 2 and 6, and the atomic fraction y is between 0.45 and 0.55, into a molten state; and quenching the molten alloy at a cooling rate sufficiently rapid to prevent crystallization of the alloy to form the object of metallic glass, and wherein the object has a lateral dimension of at least 1 mm.

15. The method of claim 14, further comprising fluxing the molten alloy with a reducing agent prior to rapid quenching.

16. The method of claim 15, wherein the reducing agent is boron oxide ($B_2O_3$).

17. The method of claim 15, wherein fluxing is performed at temperature of at least 1100° C. and for a duration of at least 500 s.

18. The method of claim 17, wherein the temperature of the molten alloy prior to quenching is at least 100 degrees above the liquidus temperature of the alloy.

19. The method of claim 17, wherein the temperature of the molten alloy prior to quenching is at least 1100° C.

20. The method of claim 14, further comprising forming a product comprising the metallic glass, wherein the product is selected from the group consisting of inductors, transformers, clutches, and DC/AC converters.

* * * * *